US007433272B2

(12) United States Patent
Watanabe

(10) Patent No.: US 7,433,272 B2
(45) Date of Patent: Oct. 7, 2008

(54) CALENDAR TIMEPIECE HAVING ECCENTRICALLY DISPOSED DATE INDICATORS

(75) Inventor: Mamoru Watanabe, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/650,790

(22) Filed: Jan. 8, 2007

(65) Prior Publication Data

US 2007/0177464 A1 Aug. 2, 2007

(30) Foreign Application Priority Data

Jan. 27, 2006 (JP) ..... 2006-019394

(51) Int. Cl.
*G04B 19/20* (2006.01)

(52) U.S. Cl. ..... 368/37; 368/35

(58) Field of Classification Search ..... 368/28, 368/29, 31, 32, 33, 34, 35, 36, 37, 38, 39, 368/40, 24

See application file for complete search history.

(56) References Cited

U.S. PATENT DOCUMENTS 7,027,360 B2 * 4/2006 Kitahara et al. ..... 368/28
7,110,326 B2 * 9/2006 Besse ..... 368/37
2005/0162983 A1 * 7/2005 Hirano et al. ..... 368/190
2006/0133214 A1 * 6/2006 Suzuki ..... 368/37

FOREIGN PATENT DOCUMENTS

FR 2847992 A1 * 6/2004

* cited by examiner

*Primary Examiner*—Renee S Luebke
*Assistant Examiner*—Jason Collins
(74) *Attorney, Agent, or Firm*—Adams & Wilks

(57) ABSTRACT

A timepiece with a calendar mechanism has a drive mechanism and a time display wheel that undergoes rotation by an operation of the drive mechanism to display time information. A first date indicator is mounted to undergo intermittent rotation to display the ones place of a date. A second date indicator is mounted to undergo intermittent rotation to display the tens place of the date. A program gear wheel intermittently rotates the first and second date indicators in accordance with operation of the drive mechanism. The program gear wheel has a first program tooth disposed on an outer peripheral part of the program gear wheel for intermittently rotating the first date indicator and a second program tooth disposed in an inner peripheral part of the program gear wheel for intermittently rotating the second date indicator.

17 Claims, 11 Drawing Sheets

CALENDAR TIMEPIECE HAVING ECCENTRICALLY DISPOSED DATE INDICATORS

BACKGROUND OF THE INVENTION

1. Field of the Invention

The present invention relates to a timepiece with a calendar mechanism including a 1st date indicator displaying a place of one out of a date, and a 2nd date indicator displaying a place of ten out of the date. More detailedly, the invention relates to a timepiece with a calendar mechanism which has been constituted such that a 1st date indicator and a 2nd date indicator are eccentrically disposed, and theist date indicator and the 2nd date indicator are rotated by using a ring-like program gear wheel.

2. Description of the Prior Art (1) Explanations of Terms:

Generally, a machine body including a drive portion of the timepiece is called a "movement". A state in which a dial and hands are attached to the movement and they are inserted into a timepiece case and have been made a complete article is called a "complete" of the timepiece. Out of both sides of a main plate constituting a substrate of the timepiece, a side in which a glass of the timepiece case exists, i.e., a side in which the dial exists, is called a "back side" or a "glass side" or a "dial side" of the movement. Out of both sides of the main plate, a side in which a case back of the timepiece case exists, i.e., a side opposite to the dial, is called a "front side" or a "case back side". A train wheel incorporated to the "front side" of the movement is called a "front train wheel". A train wheel incorporated to the "back side" of the movement is called a "back train wheel". Generally, a "12 o'clock side" denotes, in an analog type timepiece, a side in which there is disposed a graduation corresponding to 12 o'clock of the dial. A "12 o'clock direction" denotes, in the analog type timepiece, a direction toward the "12 o'clock side" from a rotation center of a hand. Further, a "3 o'clock side" denotes, in the analog type timepiece, a side in which there is disposed a graduation corresponding to 3 o'clock of the dial. A "3 o'clock direction" denotes, in the analog type timepiece, a direction toward the "3 o'clock side" from the rotation center of the hand. Further, a "6 o'clock side" denotes, in the analog type timepiece, a side in which there is disposed a graduation corresponding to 6 o'clock of the dial. A "6 o'clock direction" denotes, in the analog type timepiece, a direction toward the "6 o'clock side" from the rotation center of the hand. Further, a "9 o'clock side" denotes, in the analog type timepiece, a side in which there is disposed a graduation corresponding to 9 o'clock of the dial. A "9 o'clock direction" denotes, in the analog type timepiece, a direction toward the "9 o'clock side" from the rotation center of the hand. Additionally, there is a case where, like a "2 o'clock side" and a "2 o'clock direction", there is denoted a side in which other graduation of the dial is disposed.

(2) Conventional Timepiece with a Calendar Mechanism:

Hereunder, there is explained about a constitution of a conventional timepiece with a calendar mechanism including the 1st date indicator displaying the place of one out of the date, and the 2nd date indicator displaying the place of ten out of the date.

(2•1) Conventional Timepiece with a 1st Type Calendar Mechanism:

In a conventional timepiece with a 1st type calendar mechanism, a one-place numeral disc having an annular disc hole is driven every one day by one step, and a ten-place numeral disc is driven every ten days by one step. Numerals of 0 to 9 (i.e., ten numerals in total) are disposed in a face of the one-place numeral disc. Numerals of 1 to 3 (i.e., three numerals in total) and a blank place are disposed in a face of the ten-place numeral disc. A notch is provided in the ten-place numeral disc. The one-place numeral disc and the ten-place numeral disc are parallel disposed in a range of a display position while overlapping. A rotation center of the ten-place numeral disc is disposed in the annular disc hole of the one-place numeral disc. A program drive wheel having possessed 31 teeth performs one rotation in 31 days. An intermediate wheel is rotated by a one-place numeral program wheel. The one-place numeral disc is rotated by a drive pinion having been connected to the intermediate wheel. A pinion is rotated by a ten-place numeral program wheel, and the ten-place numeral disc integral with this pinion rotates (e.g., refer to JP-A-5-281368 Gazette).

(2•2). Conventional Timepiece with a 2nd Type Calendar Mechanism:

A conventional timepiece with a 2nd type calendar mechanism possesses a one-place disc displaying the place of one of the date, and a ten-place plate displaying the place ten of the date. A rotation center of the ten-place plate is disposed in an outside of the one-place disc. Numerals of 1 to 9, 0 to 9, 0 to 9, 0, 1, (i.e., 31 numerals in total) are disposed in a face of the one-place disc. Numerals of 0 to 3 (i.e., four numerals in total) are disposed in a face of the ten-place plate. The one-place disc possesses 31 inner teeth in its inner periphery part. The one-place disc possesses four outer teeth in its outer periphery part. By a date feed pawl having been provided in a date feed wheel, a tooth of the one-place disc can be advanced by one pitch in one day. A ten-place pinion is fixed to the ten-place plate. By an outer tooth having been provided in the one-place disc, the ten-place pinion can be rotated (e.g., refer to European Patent Application Laid-Open EP1296204A1 Gazette).

(2•3) Conventional Timepiece with a 3rd Type Calendar Mechanism:

A conventional timepiece with a 3rd type calendar mechanism possesses a 1st date indicator displaying the place of one out of the date, and a 2nd date indicator displaying the place of ten out of the date. A rotation center of the 1st date indicator and a rotation center of the 2nd date indicator are disposed in the same position. Numerals of 1 to 9, 0 to 9, 0 to 9, 0, 1, (i.e., 31 numerals in total) are disposed in a face of the 1st date indicator. Numerals of 0 to 3, 0 to 3, 0 to 3, 0, 1 (i.e., 12 numerals in total) are disposed in a face of the 2nd date indicator. Twelve notch parts are provided in the face of the 2nd date indicator. The 1st date indicator includes 31 1st date indicator tooth parts having been formed as inner teeth, and four calendar shift teeth having been formed as inner teeth. Each of the calendar shift teeth possesses a normal rotation feed part for feeding the 1st date indicator in a 1st direction, and a reverse rotation feed part for feeding the 1st date indicator in a 2nd direction reverse to the 1st direction (e.g., refer to JP-A-2005-214836 Gazette).

In the conventional timepiece with the 1st type calendar mechanism, since the program drive wheel is constituted by three gear wheels, there have been problems that a constitutional component of a drive mechanism becomes small and thus there is a difficulty in a component working, and additionally that the drive mechanism becomes thick. In the conventional timepiece with the 2nd type or 3rd type calendar mechanism, since the 31 numerals are disposed in a display face of the 1st date indicator, there has been a problem that it is difficult to enlarge a day letter.

SUMMARY OF THE INVENTION

An object of the invention is to provide a timepiece with a calendar mechanism in which the constitutional component of the drive mechanism can be designed large, and the component working is easy. Other object of the invention is to provide a timepiece with a calendar mechanism in which a program gear wheel can be thinned, and a whole movement of the timepiece can be thinly designed. Other object of the invention is to provide a timepiece with a calendar mechanism whose calendar display is large and easy to see.

The invention has been constituted such that, in a timepiece with a calendar mechanism including two date indicators, it possesses a drive mechanism for driving the timepiece with the calendar mechanism, a time instant display wheel which rotates by an operation of the drive mechanism and thereby displays a time instant information, a 1st date indicator displaying a place of one out of a date, a 2nd date indicator displaying a place of ten out of the date, and a program gear wheel having been constituted so as to be capable of intermittently rotating respectively the 1st date indicator and the 2nd date indicator on the basis of the operation of the drive mechanism. There is constituted such that a rotation center axis of the 2nd date indicator is located in an outside of the 1st date indicator and located in an inside of the program gear wheel. This timepiece with a calendar mechanism can display an information relating to a day by one among 1st day letters having been provided in the 1st date indicator and one among second day letters having been provided in the 2nd date indicator, which have been positioned while mutually adjoining.

In a timepiece with a calendar mechanism of the invention, it is good that the program gear wheel is constituted in a ring shape having a center hole, and a rotation center axis of the time instant display wheel is disposed in an inner part of the center hole of the program gear wheel. By this constitution, it is possible to realize a timepiece with a calendar mechanism in which the whole of the movement of the timepiece has been thinly constituted.

In a timepiece with a calendar mechanism of the invention, it is desirable that the program gear wheel is constituted in a ring shape having a center hole, and a program tooth for intermittently rotating the 1st date indicator is provided in an outer periphery part of the program gear wheel. Further, it is desirable that another program tooth for intermittently rotating the 2nd date indicator is provided in an inner periphery part of the program gear wheel. In this constitution, since the program gear wheel has the program tooth in the outer periphery part and the inner periphery part, it is possible to realize a timepiece with a calendar mechanism whose component number is few, which is small and whose manufacture is easy.

In a timepiece with a calendar mechanism of the invention, it is good that the program gear wheel has 31 driving program teeth for receiving the operation of the drive mechanism, the program gear wheel has 30 tooth parts for rotating the 1st date indicator, the program gear wheel has four tooth parts for rotating the 2nd date indicator, the 1st date indicator has a 1st day letter display face including ten numerals having been arranged in a circumferential direction in order of "1", "2", "3", "4", "5", "6", "8", "9", "0", and the 2nd date indicator has a 2nd day letter display face including four numerals having been arranged in a circumferential direction in order of "0", "1", "2", "3". By this constitution, it is possible to realize a timepiece with a calendar mechanism whose calendar display is, large and easy to see.

A timepiece with a calendar mechanism of the invention can be constituted so as to possess a date indicator driving wheel having been constituted so as to rotate on the basis of the operation of the drive mechanism and having been disposed in the inner part of the center hole of the program gear wheel, and a date finger having been constituted so as to rotate on the basis of a rotation of the date indicator driving wheel. The program date indicator is constituted so as to rotate on the basis of a rotation of the date finger. Further, a timepiece with a calendar mechanism of the invention can be constituted so as to possess a calendar intermediate wheel rotating on the basis of a rotation of the program date indicator. There can be constituted such that a rotation center axis of the calendar intermediate wheel is located in an outside of the 1st date indicator and located in an outside of the program gear wheel. The 1st date indicator can be constituted so as to rotate on the basis of a rotation of the calendar intermediate wheel. By this constitution, it is possible to realize a timepiece with a calendar mechanism having been compactly constituted.

A timepiece with a calendar mechanism of the invention possesses a calendar correction mechanism which can, under a state in which a winding stem has been pulled out to a winding stem position capable of performing a calendar correction, correct at least one between a display content of the 1st date indicator and a display content of the 2nd date indicator by rotating the winding stem. The calendar correction mechanism is constituted so as to include a day correction wheel. Under the state in which the winding stem has been pulled out to the winding stem position capable of performing the calendar correction, the program gear wheel can be rotated by rotating the winding stem and a rotation of the day correction wheel. By this constitution, it is possible to realize a timepiece with a calendar mechanism having been compactly constituted.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

Hereunder, an embodiment of the invention is explained on the basis of the drawings.

(1) Structure of the Embodiment of the Invention:

First, there is explained about the embodiment of the invention. The embodiment of the invention explained below is an embodiment in which a timepiece with a calendar mechanism is in the form of an analog electronic timepiece. In the following explanation, although the timepiece with the calendar mechanism of the invention has been described in connection with an analog electronic timepiece, the invention can be applied not only to the analog electronic timepiece but also to a mechanical timepiece. That is, the concept "timepiece with a calendar mechanism" in the present specification is a concept applied to an "analog electronic timepiece", a "mechanical timepiece", and to all analog timepieces of other operation principles, as well.

Figure 4:
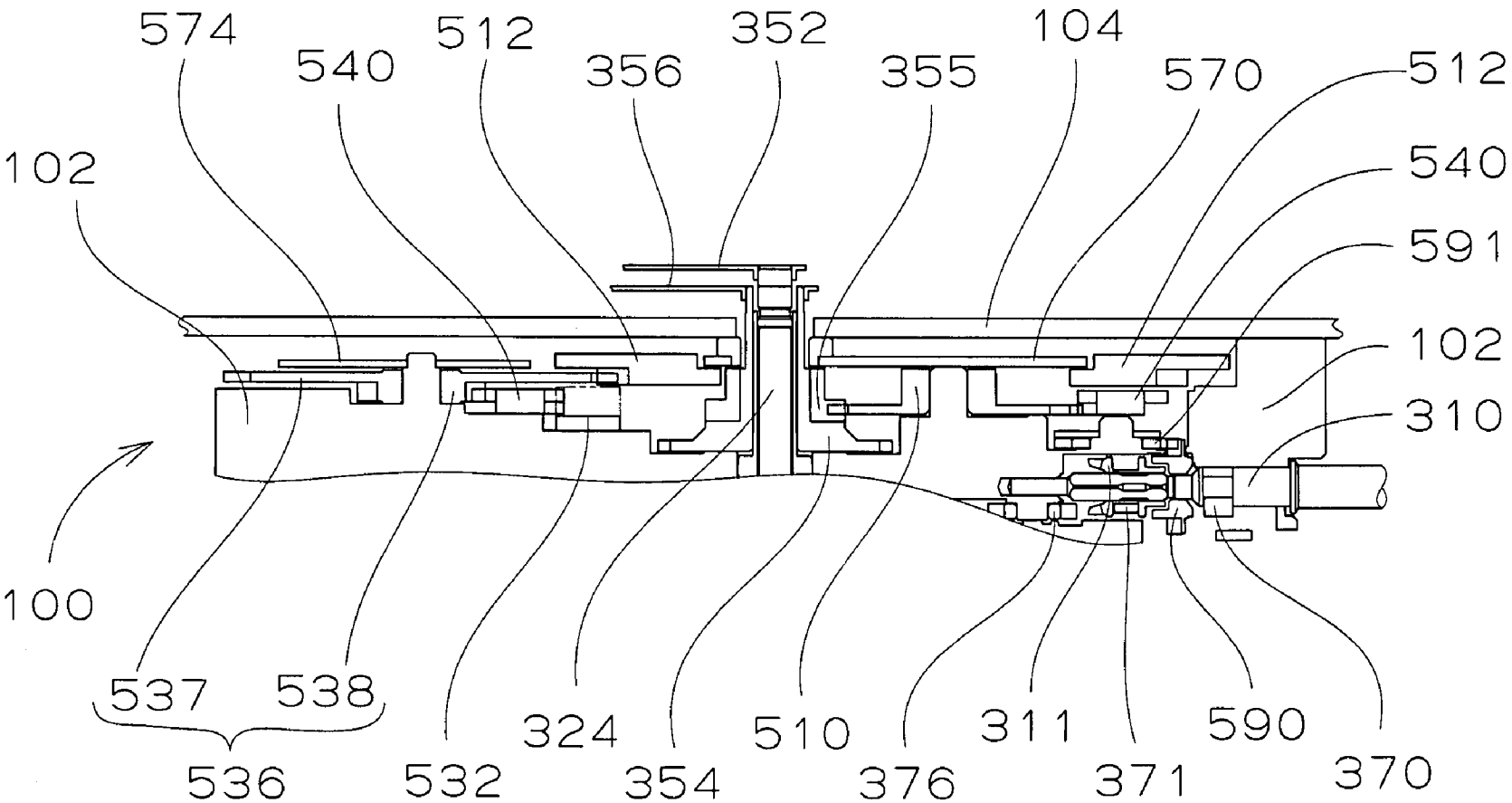
FIG. 4 is a partial sectional view showing portions of the 1st date indicator, the program gear wheel and a calendar intermediate wheel in the embodiment of the invention.
Figure 5:
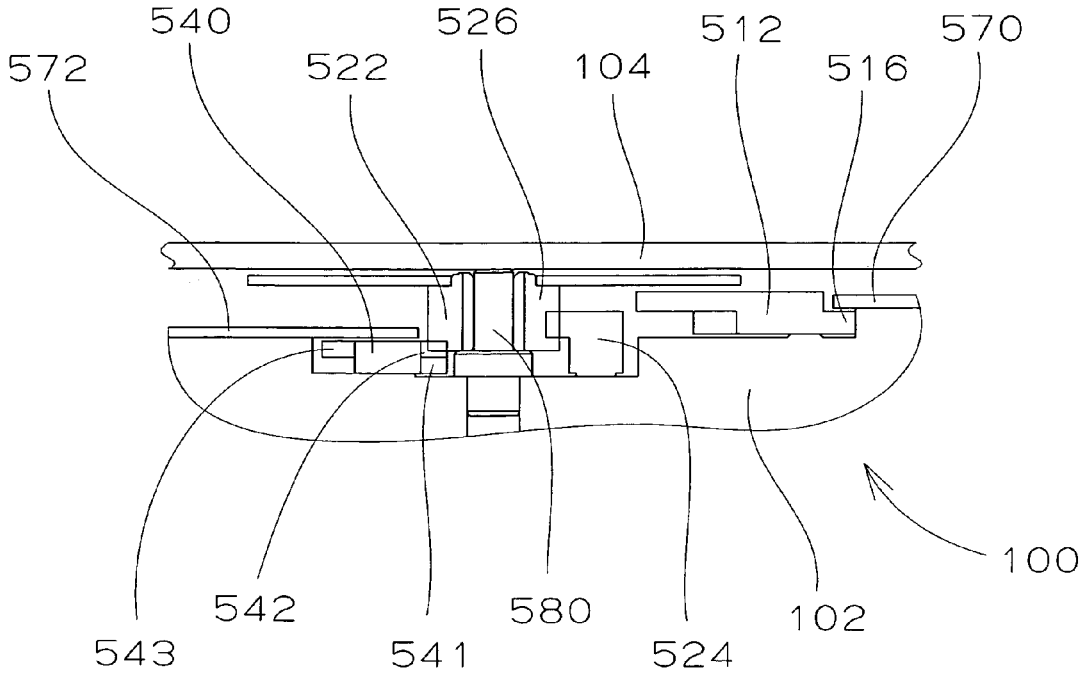
FIG. 5 is a partial sectional view showing portions of the 2nd date indicator and the program gear wheel in the embodiment of the invention.
Figure 6:
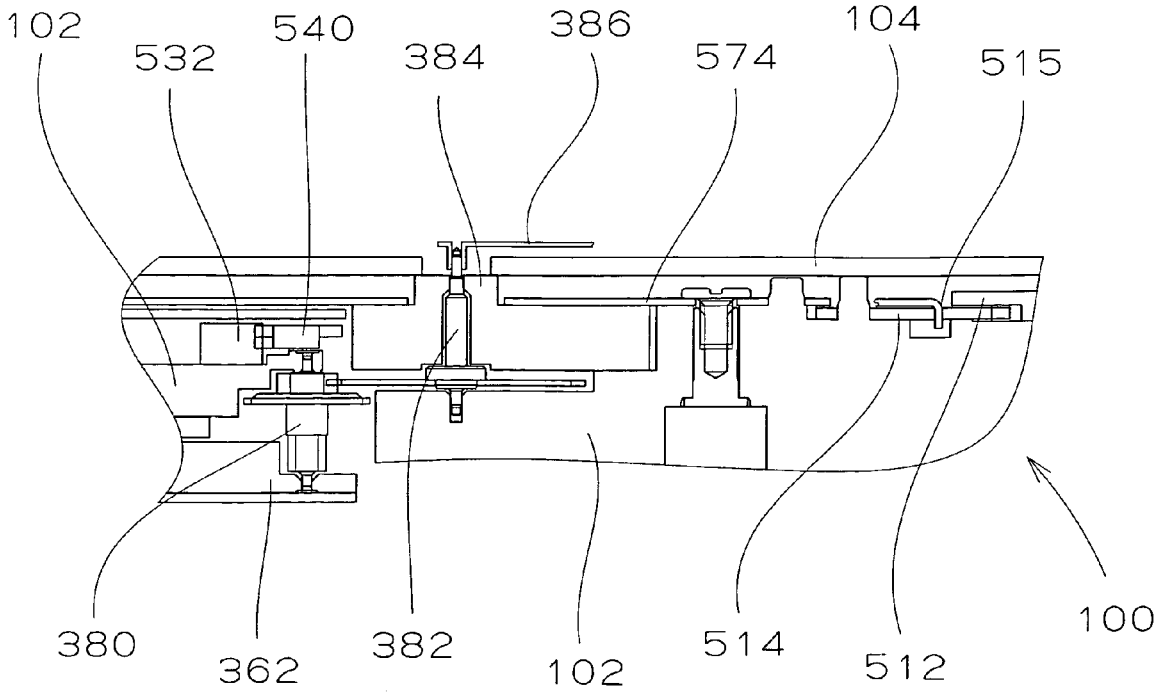
FIG. 6 is a partial sectional view showing portions of the program gear wheel and a second wheel in the embodiment of the invention.
Figure 12:
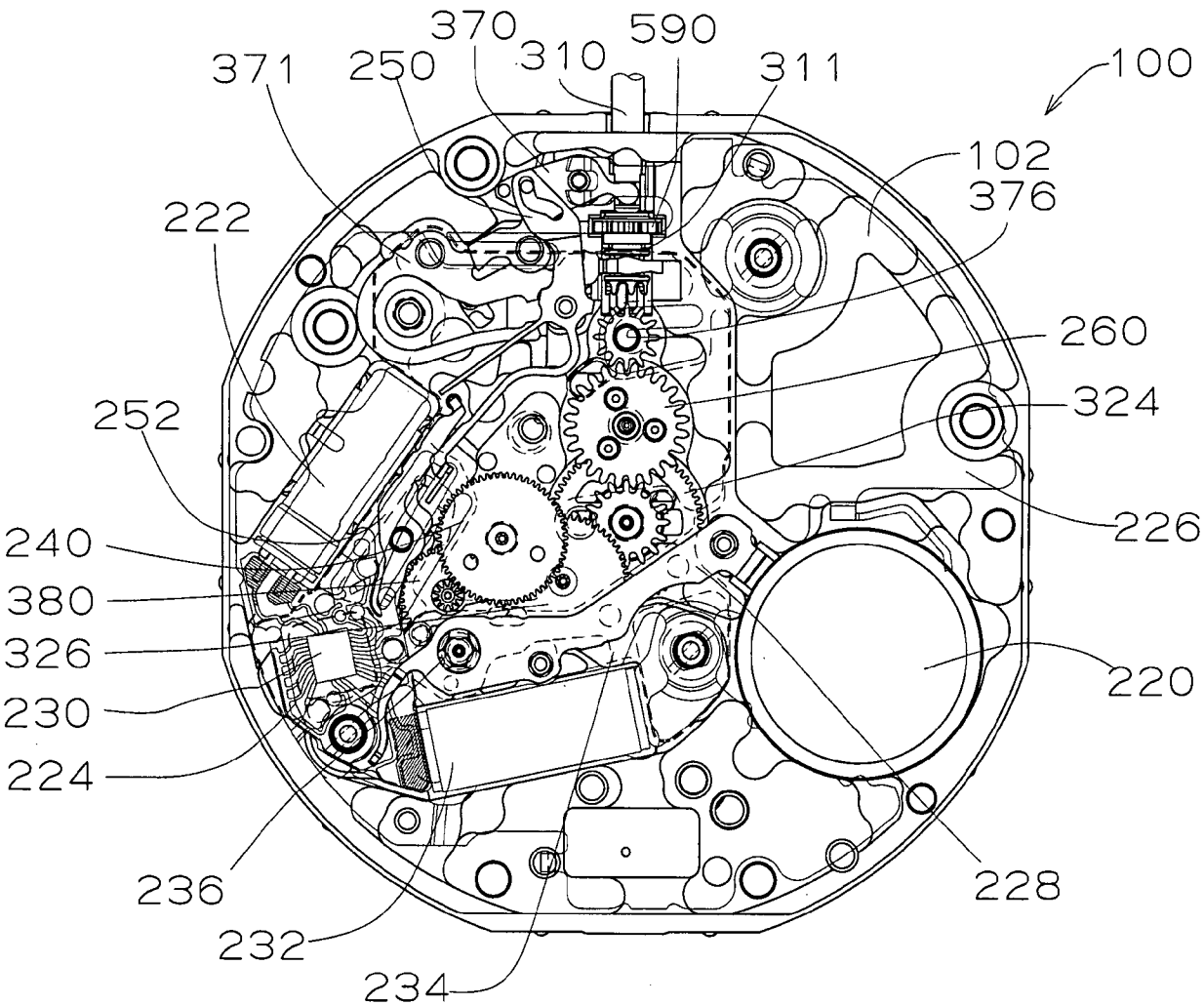
FIG. 12 is a schematic plan view showing a structure when the movement has been seen from a case back side in the embodiment of the invention.

(1•1) Structure in the Front Side of the Movement:

Hereunder, a structure in the front side of the movement is explained. Referring to FIG. 4, FIG. 6 and FIG. 12, a movement 100 possesses a main plate 102. A winding stem 310 is rotatably disposed in the 3 o'clock side of the main plate 102. A battery 220 constituting a power source of the timepiece is disposed in the case back side of the main plate 102. A crystal unit 222 constituting an oscillation source of the timepiece is disposed in the case back side of the main plate 102. A crystal oscillator is accommodated in the crystal unit 222. A lead part of the crystal unit 222 is fixed to a circuit substrate 224. A battery plus terminal 226 is disposed so as to conduct a positive electrode of the battery 220 and a plus pattern of the circuit substrate 224. A battery minus terminal 228 is disposed so as to conduct a negative electrode of the battery 220 and a minus pattern of the circuit substrate 224. In an integrated circuit (IC) 230, there are built in an oscillation part (oscillator) outputting a reference signal on the basis of an oscillation of the crystal oscillator, a frequency dividing part (divider) frequency-dividing an output signal of the oscillation part, and a drive part (driver) outputting a motor drive signal driving a step motor on the basis of an output signal of the frequency dividing part. The integrated circuit 230 is fixed to the circuit substrate 224. A coil block 232, a stator 234 and a rotor 236 are disposed in the case back side of the main plate 102.

A fifth wheel & pinion 380 is constituted so as to rotate on the basis of a rotation of the rotor 236. A second wheel & pinion 240 is constituted so as to rotate on the basis of a rotation of the fifth wheel & pinion 380. A third wheel & pinion 326 is constituted so as to rotate on the basis of a rotation of the second wheel & pinion 240. A minute wheel 324 is constituted so as to rotate on the basis of a rotation of the third wheel & pinion 326. A slip mechanism is provided between a minute gear wheel and a center pinion. By providing the slip mechanism, when performing a hand setting, it is possible to rotate a minute hand 352 and an hour hand 356 by rotating the winding stem 310 under a state that a rotation of the front train wheel has been stopped. The minute hand 352 is attached to the minute wheel 324.

A second wheel 382 is constituted so as to operate on the basis of a rotation of the fifth wheel & pinion 380. A gear wheel part of the second wheel 382 is constituted so as to mesh with a fifth lower pinion. There is constituted such that, by the rotation of the rotor 236, the second wheel 382 rotates through the rotation of the fifth wheel & pinion 380. The second wheel 382 is constituted so as to perform one rotation in one minute. A second hand 386 is, attached to a tip part of an upper shaft part of the second wheel 382. A letter, a numeral, an abbreviated letter and the like for displaying the "second" are provided in a dial 104. There is constituted such that an information relating to the "second" that is a time instant information can be displayed by the second hand 386, the numeral and the like.

A train wheel setting lever 250 is disposed in the case back side of the main plate 102 in order to set the second wheel & pinion 240 when performing the hand setting by pulling out the winding stem 310 to its 2nd stage. A reset lever 252 is provided in order to reset an operation of the integrated circuit 230 when performing the hand setting by pulling out the winding stem 310 to its 2nd stage. A minute wheel 260 is constituted so as to rotate on the basis of a rotation of the minute wheel 324. An hour wheel 354 is constituted so as to rotate on the basis of a rotation of the minute wheel 260.

A switching mechanism is disposed in the case back side of the main plate 102. As a modified example, the switching mechanism can be disposed in the dial side of the main plate 102 as well. The switching mechanism is constituted so as to include a setting lever 370 and a yoke 371. A time instant setting mechanism includes the winding stem 310 and a clutch wheel 311. A day correction can be performed by rotating the winding stem 310 under a state that the winding stem 310 has been pulled out to its 1st stage. A time instant display can be corrected by rotating the winding stem 310 under a state that the winding stem 310 has been pulled out to its 2nd stage.

The minute wheel 324 includes a minute gear wheel (not shown in the drawing) and a minute pinion. The minute gear wheel is constituted so as to mesh with a third pinion. The minute pinion and the minute gearwheel are provided with a slip mechanism having been constituted such that the minute pinion can slip with respect to the minute gear wheel. There is constituted such that the minute wheel 260 rotates by a rotation of the third wheel & pinion 326 through a rotation of the minute wheel 324. The minute pinion is constituted so as to mesh with the minute gear wheel. The hour wheel 354 is constituted so as to mesh with the minute pinion.

The fifth wheel & pinion 380 is provided so as to be rotatable with respect to the main plate 102 and a train wheel bridge 362. The second wheel 382 rotates by the rotation of the rotor 236 through a rotation of the fifth wheel & pinion 380. The second wheel 382 is provided so as to be rotatable with respect to the main plate 102 and a second wheel bridge 384. The second wheel 382 is constituted so as to perform one rotation in one minute. The second hand 386 having been attached to the second wheel 382 displays the "second".

The minute wheel 324, the minute wheel 260 and the hour wheel 354 constitute the back train wheel. By the rotation of the rotor 236, the minute wheel 324 performs one rotation in one hour through the fifth wheel & pinion 380, the second wheel & pinion 240 and the third wheel & pinion 326. The minute hand 352 having been attached to the minute pinion of the minute wheel 324 displays the "minute". The hour wheel 354 performs one rotation in 12 hours on the basis of the rotation of the minute wheel 324 through the rotation of the minute wheel 260. The hour hand 356 having been attached to the hour wheel 354 displays the "hour". If the winding stem 310 is pulled out to its 2nd stage, the minute wheel can be rotated by rotating the winding stem 310 through rotations of the clutch wheel 311 and a setting wheel 376. If the minute wheel is rotated under the state that the winding stem 310 is in its 2nd stage, it is possible to correct the time instant display by rotating the minute pinion and the hour wheel 354.

(1•2) Constitution of a Date Indicator Feed Mechanism:

Next, there is explained about a constitution of a date indicator feed mechanism. Referring to FIG. 1 to FIG. 6, the date feed mechanism includes a date indicator driving wheel 510, a date finger or date feed pawl 511 having been provided integrally with the date indicator driving wheel 510, a program gear wheel 540, a program gear wheel jump control lever 532, a program gear wheel jump control lever spring 534, and a calendar intermediate wheel 536. The calendar intermediate wheel 536 is incorporated so as to be rotatable with respect to a calendar intermediate wheel having been provided in the main plate 102. The date indicator driving wheel 510 and the date feed pawl 511 are incorporated so as to be rotatable with respect to a date indicator driving wheel pin having been provided in the main plate 102. A date feed gear wheel part 355 of the hour wheel 354 meshes with a gear wheel part of the date indicator driving wheel 510. There is constituted such that, by the fact that the hour wheel 354 rotates, the date indicator driving wheel 510 performs one rotation in 24 hours. The date feed pawl 511 is constituted so as to rotate integrally on the basis of a rotation of the date indicator driving wheel 510. The date indicator driving wheel 510 is disposed between the main plate 102 and a date indicator maintaining plate 570. It is desirable that a rotation center of the date indicator driving wheel 510 is disposed between the "2 o'clock direction" and the "3 o'clock direction" of the dial.

The program gear wheel 540 is constituted in a ring shape having a center hole. The program gear wheel 540 includes a first (1st) program tooth 541 provided in an inner periphery and rotated by a rotation of the date feed pawl 511, a second (2nd) program tooth 542 provided in the inner periphery and intermittently rotating a second (2nd) date indicator 522, and a third 3rd program tooth 543 provided on an outer periphery and intermittently rotating a first (1st) date indicator 512 through the calendar intermediate wheel 536. The 1st program tooth 541 and the 2nd program tooth 542 can be disposed so as to be laminated. A tip part of the first(1st) program tooth 541 is incorporated so as to be rotatable with respect to an outer periphery of a program gear wheel guide shaft part having been provided in the main plate 102. A program gear wheel maintaining plate 572 is disposed in a side, of the main plate 102, in which the dial 104 exists.

The program gear wheel 540 is disposed between the main plate 102 and the program gear wheel maintaining plate 572. A setting part of the program gear wheel jump control lever 532 sets two tooth parts of the 1st program tooth 541. A rotation of the program gear wheel 540 is set by the program gear wheel jump control lever 532. The program gear wheel jump control lever spring 534 can be formed integrally with a calendar intermediate wheel maintaining plate 574. By an elastic force of the program gear wheel jump control lever spring 534, the setting part of the program gear wheel jump control lever 532 is pushed to the two tooth parts of the 1st program tooth 541. The date indicator driving wheel 510 is constituted so as to rotate on the basis of an operation of a drive mechanism, and disposed in the center hole of the program gear wheel 540.

There is constituted such that rotation center axes of the hour wheel 354 and the minute wheel 324, which constitute a time instant display wheel, are located in an inside of the center hole of the program gear wheel 540. There is constituted such that a rotation center axis of the date indicator driving wheel 510 is located in an inside of the center hole of the program gear wheel 540. There is constituted such that a rotation center axis of the calendar intermediate wheel 536 is located in an inside of the program gear wheel 540. There is constituted such that a rotation center axis of the 1st date indicator 512 is located in the inside of the center hole of the program gear wheel 540. There is constituted such that a rotation center axis of the 2nd date indicator 522 is located in the inside of the program gear wheel 540.

The calendar intermediate wheel 536 includes a calendar intermediate gear wheel 537 and a calendar intermediate pinion 538. The calendar intermediate wheel 536 is disposed between the main plate 102 and the calendar intermediate maintaining plate 574. The calendar intermediate pinion 538 is constituted so as to mesh with the 3rd program tooth 543. The calendar intermediate gear wheel 537 is constituted so as to mesh with a 1st date indicator tooth 516.

Figure 3:
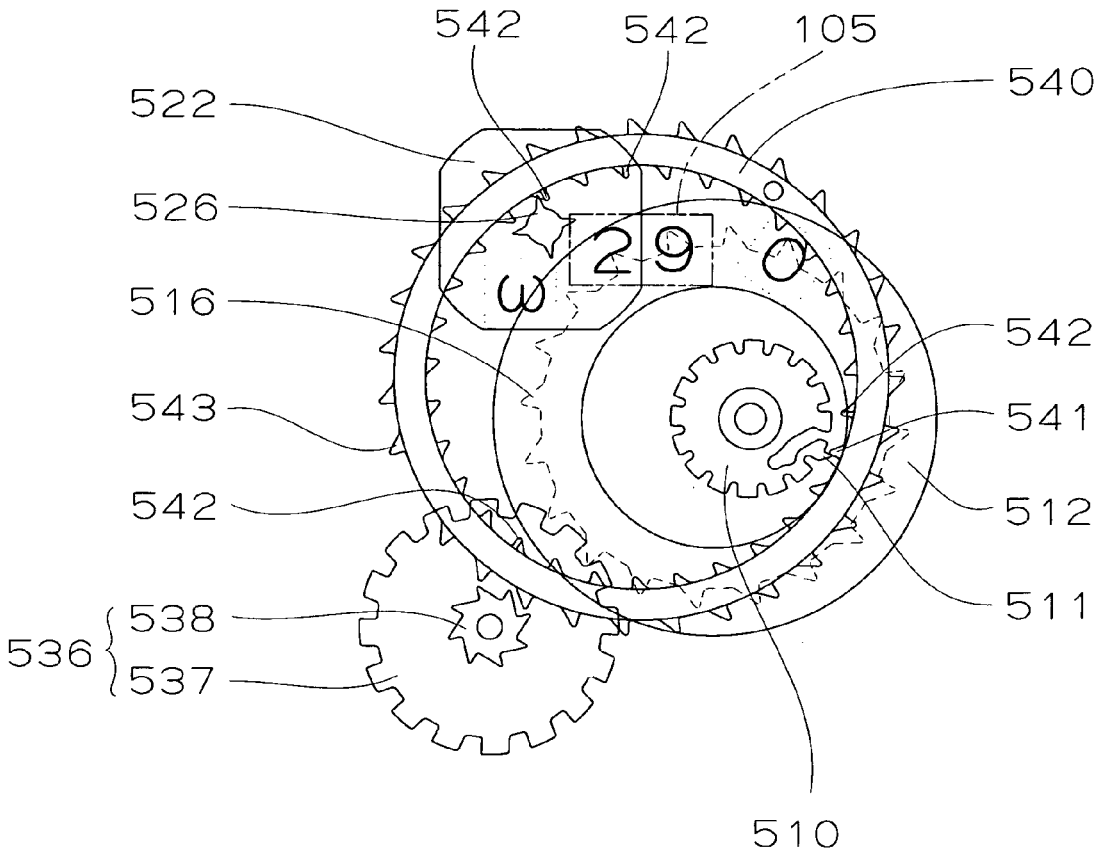
FIG. 3 is an enlarged partial plan view showing portions of the 1st date indicator, the 2nd date indicator and the program gear wheel under a state displaying "29th day" in the embodiment of the invention.

Referring to FIG. 3, the 1st program tooth 541 includes 31 tooth parts having been formed so as to become an equal angle interval. The angle interval of the tooth parts of the 1st program tooth 541 is 360/31 degrees. The 3rd program tooth 543 includes 30 tooth parts having been formed so as to become an equal angle interval. The angle interval of the tooth parts of the 3rd program tooth 543 is 360/31 degrees in 29 places and 2×360/31 degrees in only one place. The 2nd program tooth 542 includes four tooth parts. The angle interval of the tooth parts of the 2nd program tooth 542 is, in order, 9×360/30 degrees, 10×360/30 degrees, 10×360/30 degrees, and 2×360/30 degrees.

Figure 1:
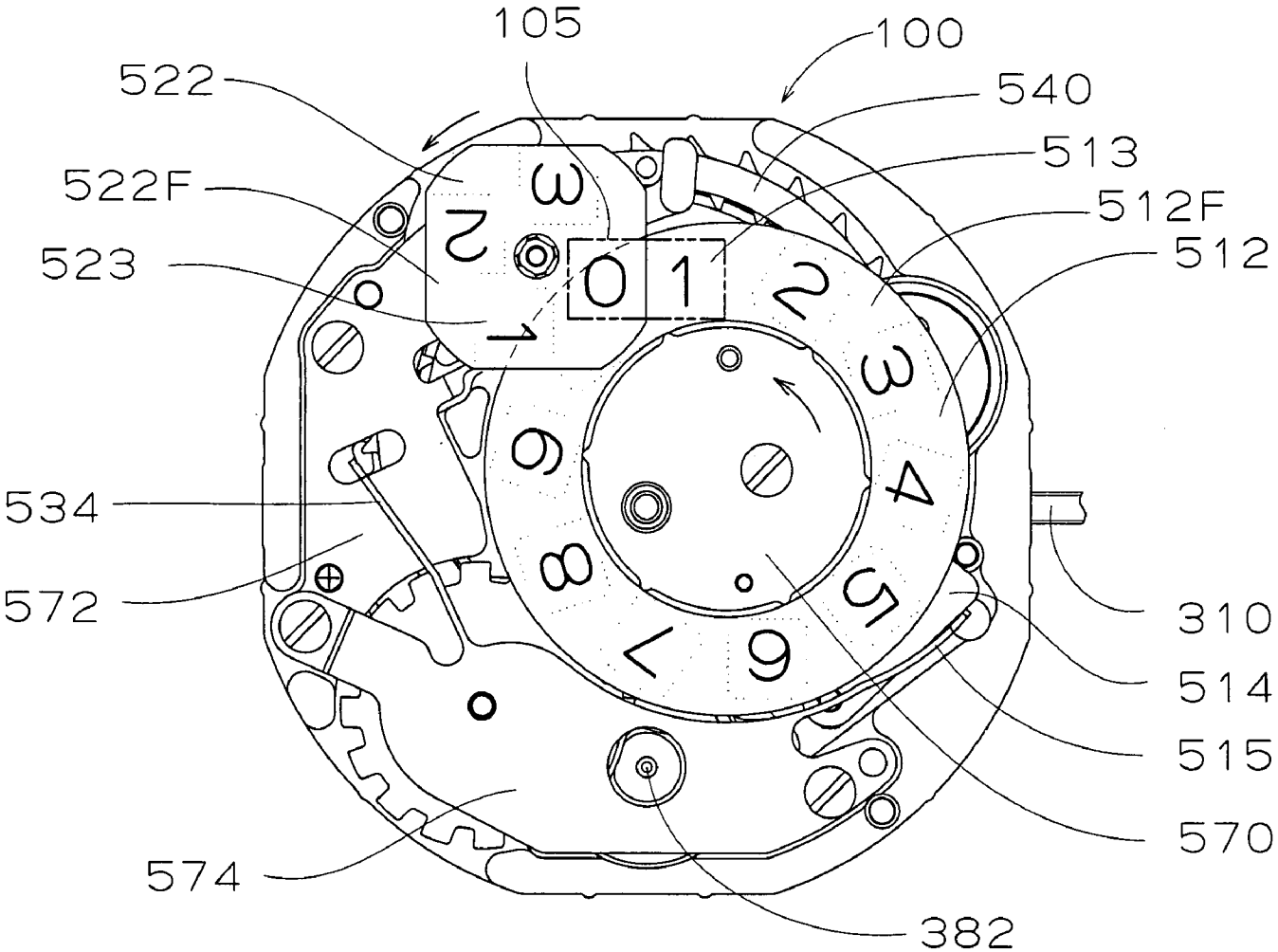
FIG. 1 is a schematic plan view showing a 1st date indicator, a 2nd date indicator and the like when a movement has been seen from a dial side in an embodiment of the invention.

Referring to FIG. 1, the 1st date indicator 512 is provided in order to display the ones place of the date. The 2nd date indicator 522 is provided in order to display the tens place of the date. It is desirable that a rotation center of the 1st date indicator 512 is disposed between the "2 o'clock direction" and the "3 o'clock direction" of the dial 104. It is desirable that a rotation center of the 2nd date indicator 522 is disposed between the "11 o'clock direction" and the "12 o'clock direction" of the dial 104. It is good that an outer diameter of the 1st date indicator 512 is formed in a dimension larger than an outer diameter of the 2nd date indicator 522. It is good that one part of an external shape of the 1st date indicator 512 overlaps with one part of an external shape of the 2nd date indicator 522. The 1st date indicator 512 and the 2nd date indicator 522 are positioned while mutually adjoining, and constituted so as to be capable of displaying information relating to a day from a date window 105 of the dial 104 by using one among 1st day characters or letters having been provided in the 1st date indicator 512 and one among 2nd day characters or letters having been provided in the 2nd date indicator 522. By this constitution, it is possible to realize a timepiece with a calendar mechanism whose calendar display is large and easy to see.

FIG. 1 shows a state displaying the fact that, in the timepiece with the calendar mechanism of the invention, the date is "01 day", i.e., "1st day", by providing the date window 105 (shown by an imaginary line) in a position of the 12 o'clock direction of the dial 104, and by the facts that the 1st date indicator 512 displays "1" from this date window 105 and that the 2nd date indicator 522 displays "0".

Referring to FIG. 1 to FIG. 5, the 1st date indicator 512 is incorporated rotatably with respect to the main plate 102. The 1st date indicator 512 has the 20 1st date indicator teeth 516 having been formed so as to become the equal angle interval. A 1st date jump control lever 514 for setting a position of the 1st date indicator 512 in a rotation direction is incorporated to the main plate 102. The 1st date jump control lever 514 includes a setting part for setting the 1st date indicator tooth 516. A 1st date jump control lever spring 515 can be formed integrally with the calendar intermediate wheel maintaining plate 574. There is constituted such that, by an elastic force of the 1st date jump control lever spring 515, the setting part of the 1st date jump control lever 514 can set two among the 1st date indicator teeth 516.

The 2nd date indicator 522 is incorporated rotatably with respect to a 2nd date indicator rotation shaft 580 having been provided in the main plate 102. The 2nd date indicator 522 has four 2nd date indicator teeth 526 having been formed so as to become the equal angle interval. A 2nd date jump control lever 524 for setting a position of the 2nd date indicator 522 in a rotation direction is incorporated to the main, plate 102. The 2nd date jump control lever 524 includes a setting part for setting the 2nd date indicator 522. A 2nd date jump control lever spring 525 can be formed integrally with a program gear wheel maintaining plate 572. There is constituted such that, by an elastic force of the 2nd date jump control lever spring 525, the setting part of the 2nd date jump control lever 524 can set two among the 2nd date indicator teeth 526.

Referring to FIG. 1, 1st day letters 513 comprising ten numerals are provided in a 1st day letter display face 512F of the 1st date indicator 512. The 1st day letters 513 include the numerals in a circumferential direction in order of "0", "1", "2", "3", "4", "5", "6", "7", "8", "9". The ten numerals constituting the 1st day letters 513 are disposed in the 1st day letter display face 512F at an equal angle interval, i.e., an interval of (360/10) degrees. There is constituted such that, under a state shown in FIG. 1, although "1" among the 1st date letters 513 is disposed in the date window 105 having been provided in the dial 104, if the 1st date indicator 512 rotates by one pitch in a direction shown by an arrow, "2" among the 1st date letters 513 is disposed in the date window 105. There is constituted such that, hereafter similarly, if the 1st date indicator 512 rotates by one pitch in the direction shown by the arrow, one among the 1st date letters 513 is disposed in the date window 105 in order of "3", "4", "5", "6", "7", "8", "9", "0", "1", "2". By this constitution, it is possible to realize a timepiece with a calendar mechanism whose calendar display is large and easy to see.

2nd date letters 523 comprising four numerals are provided in a 2nd day letter display face 522F of the 2nd date indicator 522. The 2nd day letters 523 include the numerals in a circumferential direction in order of "0", "1", "2", "3". The four numerals constituting the 2nd day letters 523 are disposed in the 2nd day letter display face 522F at an equal angle interval, i.e., an interval of (360/4) degrees. There is constituted such that, under the state shown in FIG. 1, although "0" among the 2nd date letters 523 is disposed in the date window 105, if the 2nd date indicator 522 rotates by one pitch in a direction shown by an arrow, "1" having been disposed after "0" among the 2nd day letters 523 is disposed in the date window 105. There is constituted such that, hereafter similarly, if the 2nd date indicator 522 rotates by one pitch in the direction shown by the arrow, one among the 2nd day letters 523 is disposed in the date window 105 in order of "2", "3", "0", "1". Or, such a constitution is also possible that, in the 2nd date indicator 522, instead of providing the numeral of "0", that position is made a "white paper" portion (i.e., a blank portion in which no numeral is provided). By this constitution, it is possible to realize a timepiece with a calendar mechanism whose calendar display is large and easy to see.

Figure 11:
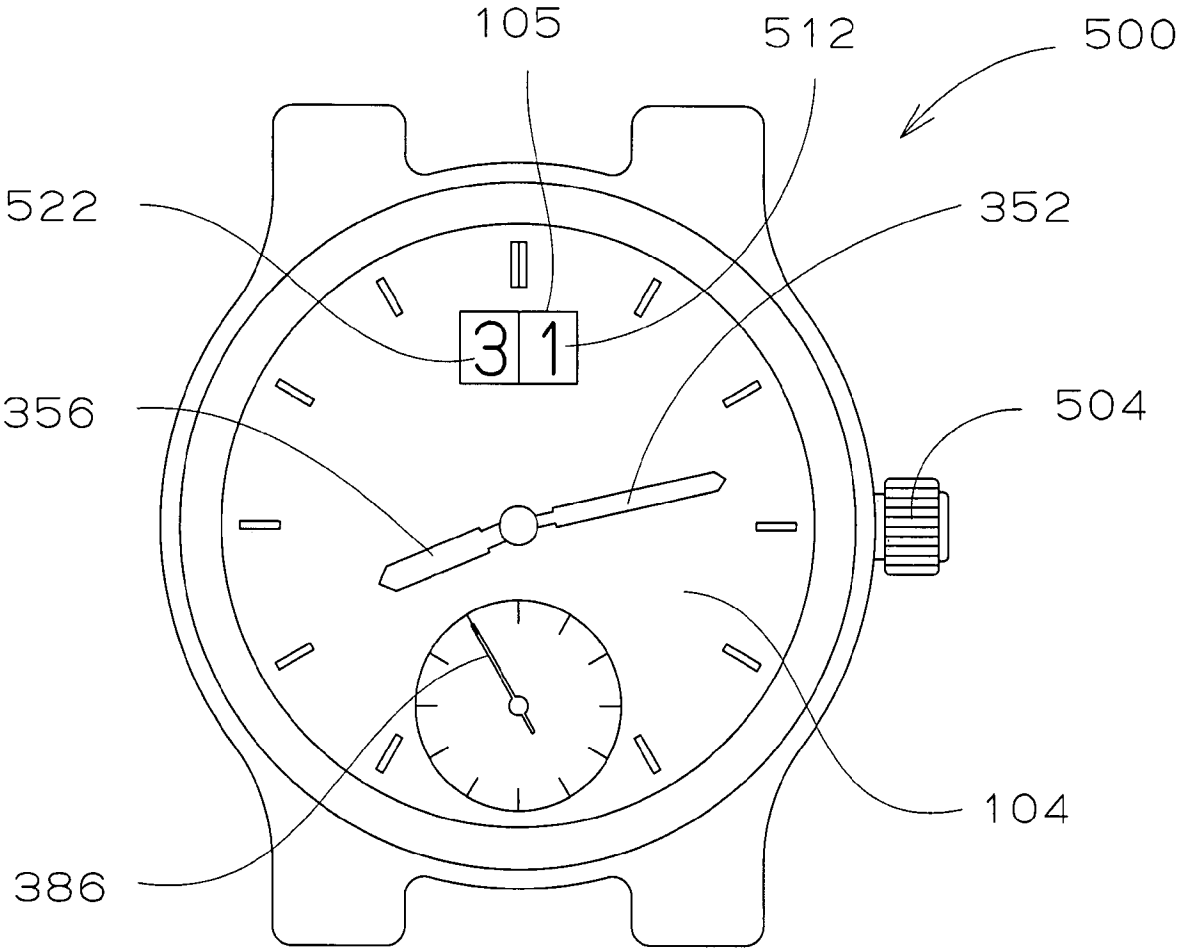
FIG. 11 is a plan view showing a complete under a state displaying "31st day" by a constitution, in which a date window has been disposed in a 12 o'clock direction of a dial, in the embodiment of the invention.

The state shown in FIG. 1 is a state in which, in the movement 100, "0" among the 2nd day letters 523 is disposed in a left side portion of the date window 105, and "1" among the 1st day letters 513 is disposed in a right side portion of the date window 105. The 2nd day letter display face 522F is disposed in a position more adjacent to the dial 104 than the 1st day letter display face 512F. Referring to FIG. 11, in a complete 500 of the timepiece with the calendar mechanism of the invention, the date window 105 is formed in a position of the 12 o'clock direction of the dial 104. In the complete 500, "3" among the 2nd day letters 523 of the 2nd date indicator 522 is disposed in the left side portion in the date window 105, and "1" among the 1st day letters 513 of the 1st date indicator 512 is disposed in the right side portion in the date window 105. Accordingly, FIG. 11 is a state in which the complete 500 displays. "31st day" by the 2nd day letter 523 of the 2nd date indicator 522 and the 1st day letter 513 of the 1st date indicator 512.

Referring to FIG. 1 to FIG. 7, by the fact that the hour wheel 354 rotates, the date indicator driving wheel 510 rotates, and the date finger 511 rotates the program gear wheel 540 by for one tooth in a counterclockwise direction only by one time in one day. By the fact that the program gear wheel 540 rotates, the 3rd program tooth 543 rotates the 1st date indicator 512 by for two teeth in the counterclockwise direction through a rotation of the calendar intermediate wheel 536, and thereby it is possible to change the day letter, which is displayed from the date window 105 by the 1st date indicator 512, to "2" from "1". The rotation of the 1st date indicator 512 for two teeth is set by the 1st date jump control lever 514.

Figure 7:
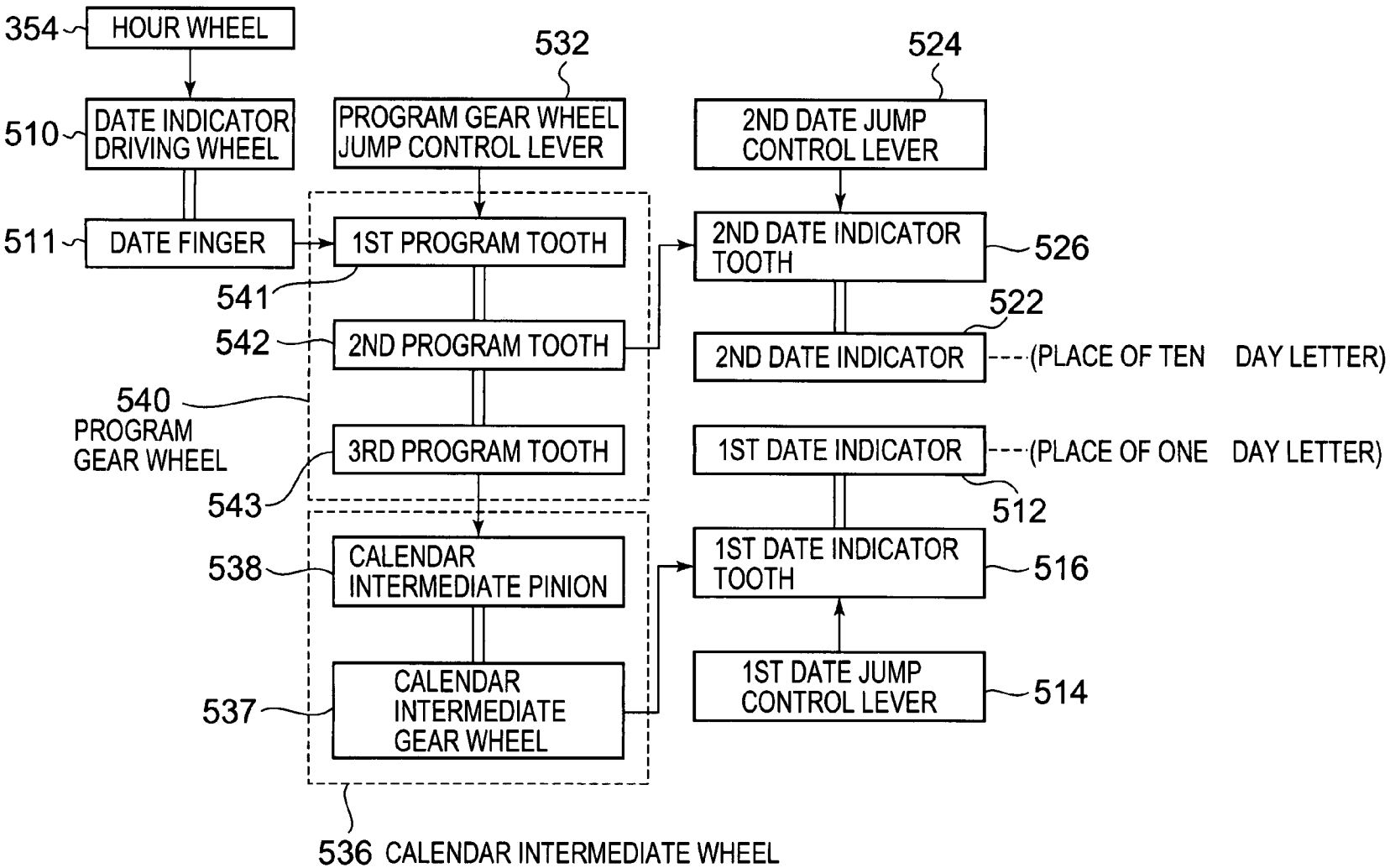
FIG. 7 is a block diagram showing a portion of a calendar mechanism in the embodiment of the invention.

Referring to FIG. 7, there is constituted such that, when changing the date letter displayed from the date window 105 by the 1st day indicator 512 to "0" from "9", at the same time as the 1st indicator 512 is rotated by the fact that the 3rd program tooth 543 rotates, the 2nd program tooth 542 rotates the 2nd date indicator 522 by for one tooth in the counterclockwise direction, and thus it is possible to change the day letter displayed from the date window 105 by the 2nd date indicator 522 to "3" from "2". The rotation of the 2nd date indicator 522 for one tooth is set by the 2nd date jump control lever 524. It is good to constitute such that a date feed operation like the above is completed when the hour hand 356 and the minute hand 352 display 12 o'clock 0 minute.

Figure 2:
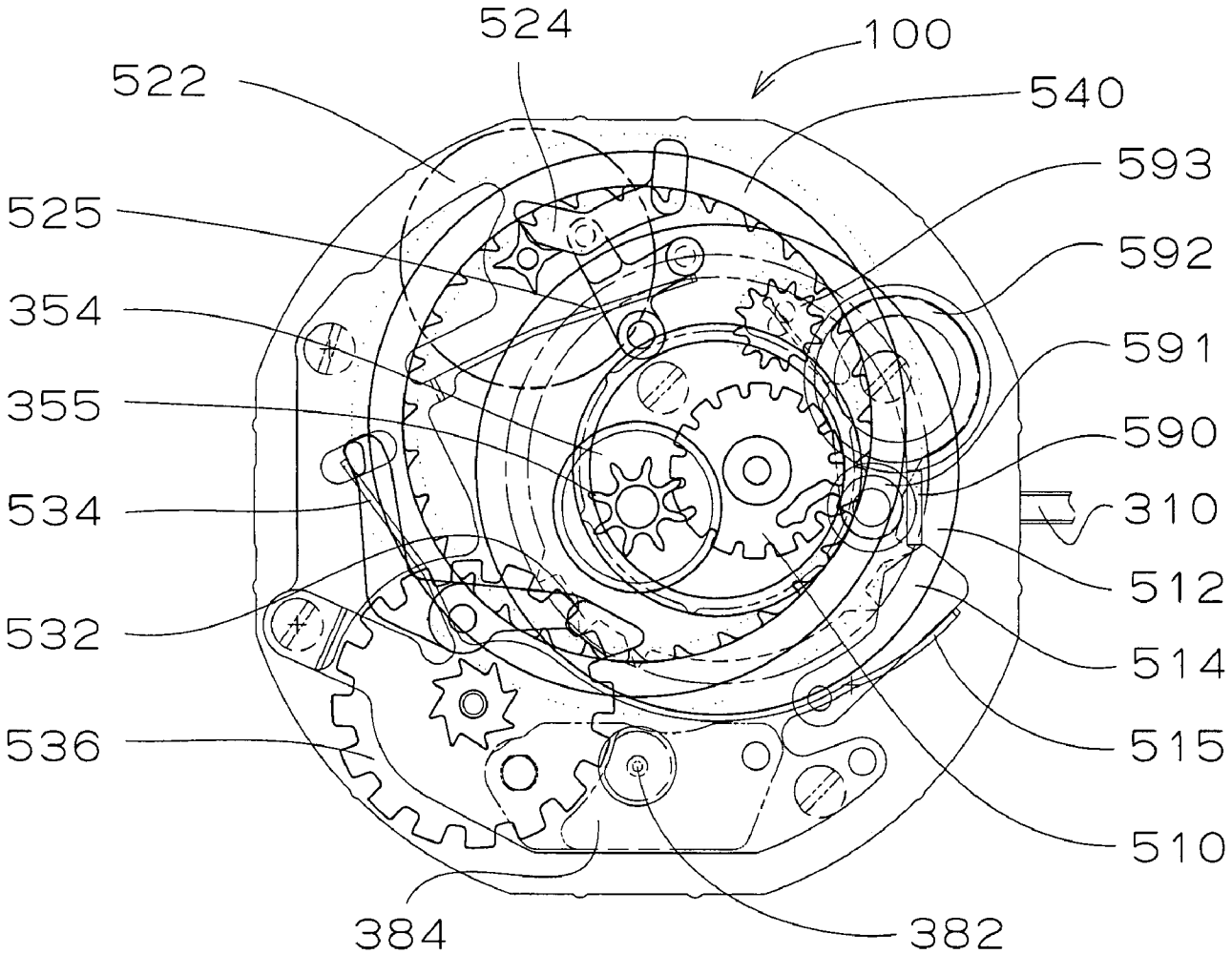
FIG. 2 is a schematic plan view showing a program gear wheel and a correction mechanism when the movement has been seen from the dial side in the embodiment of the invention.

(1•3) Constitution of a Calendar Correction Mechanism:

Referring to FIG. 1, FIG. 2 and FIG. 4, a calendar correction mechanism includes a 1st calendar correction wheel 590, a 2nd calendar correction wheel 591, a 3rd calendar correction wheel 592, and a calendar correction wheel 593. The calendar correction wheel 593 is constituted so as to be capable of fluctuating along a guide hole having been provided in the main plate 102. There is constituted such that, if the winding stem 310 is pulled out from its 0th stage to 1st stage, an angular part of the winding stem 310 can engage with a circular hole part of the 1st calendar correction wheel 590. There is constituted such that, if the winding stem 310 is rotated in a 1st direction under a state that the winding stem 310 has been pulled out to its 1st stage, the 1st calendar correction wheel 590 rotates, the calendar correction wheel 593 fluctuates in the clockwise direction through rotations of the 2nd calendar correction wheel 591 and the 3rd calendar correction wheel 592, a gear wheel part of the calendar correction wheel 593 rotates till a position engaging with the 1st program tooth 541 and stops, and the calendar correction wheel 593 rotates in that calendar correction position. There is constituted such that, if the calendar correction wheel 593 rotates in the calendar correction position, the calendar correction wheel 593 can rotate the program gear wheel 540 in the counterclockwise direction.

There is constituted such that, if the winding stem 310 is rotated in a 2nd direction reverse to the 1st direction under a state that the winding stem 310 has been pulled out to its 1st stage, the 1st calendar correction wheel 590 rotates, the calendar correction wheel 593 fluctuates in the counterclockwise direction through rotations of the 2nd calendar correction wheel 591 and the 3rd calendar correction wheel 592, and the gear wheel part of the calendar correction wheel 593 rotates till a position not engaging with the 1st program tooth 541 and stops in an idling position. There is constituted such that, even if the calendar correction wheel 593 rotates in the idling position, it is impossible to rotate the program gear wheel 540. There is constituted such that, if the winding stem 310 is rotated in the 1st direction under the state that the winding stem 310 has been pulled out to its 1st stage, the 1st calendar correction wheel 590 rotates, the program gear wheel 540 rotates by for one tooth in the counterclockwise direction by the fact that the calendar correction wheel 593 rotates through rotations of the 2nd calendar correction wheel 591 and the 3rd calendar correction wheel 592, and it is possible to rotate the 1st date indicator 512 by for one tooth in the counterclockwise direction by a rotation of the 3rd program tooth 543 through a rotation of the calendar intermediate wheel 536. There is constituted such that, when changing the day letter displayed from the date window 105 by the 1st date indicator 512 to "0" from "9", at the same time as the 3rd program tooth 543 rotates the 1st date indicator 512 through the calendar intermediate wheel 536, the 2nd program tooth 542 can rotate the 2nd date indicator 522 by for one tooth in the counterclockwise direction.

(1•4) Operation of a Normal Hand Motion:

Next, there is explained about an operation of a normal hand motion. Referring to FIG. 4, FIG. 6 and FIG. 12, on the basis of an oscillation of the crystal oscillator of the crystal unit 222, an oscillation part of the integrated circuit 230 outputs a reference signal, and the frequency dividing part frequency-divides an output signal of the oscillation part. On the basis of the output signal of the frequency dividing part, the drive part outputs a motor drive signal driving the step motor. If the coil block 232 inputs the motor drive signal, the stator 234 is magnetized, thereby rotating the rotor 236. On the basis of the rotation of the rotor 236, the second wheel & pinion 240 rotates through a rotation of the fifth wheel & pinion 380. On the basis of the rotation of the fifth wheel & pinion 380, the second wheel 382 performs one rotation in one minute. The 3rd wheel & pinion 326 rotates on the basis of the rotation of the second wheel & pinion 240. The minute wheel 324 performs one rotation in one hour on the basis of the rotation of the third wheel & pinion 326. The minute wheel 260 rotates on the basis of the rotation of the minute wheel 324. The hour wheel 354 performs one rotation in 12 hours on the basis of the rotation of the minute wheel 260.

(1•5) Operation of a Calendar Feed:

Next, there is explained about an operation of a calendar feed. Referring to FIG. 3, the state shown in FIG. 3 is a state in which "2" among the 2nd day letters 523 is disposed in the left side portion of the date window 105, and "9" among the 1st day letters 513 is disposed in the right side portion of the date window 105. Accordingly, the state shown in FIG. 3 displays "29th day" in the complete 500 by the 2nd day letter 523 of the 2nd date indicator 522 and the 1st day letter 513 of the 1st date indicator 512.

Figure 8:
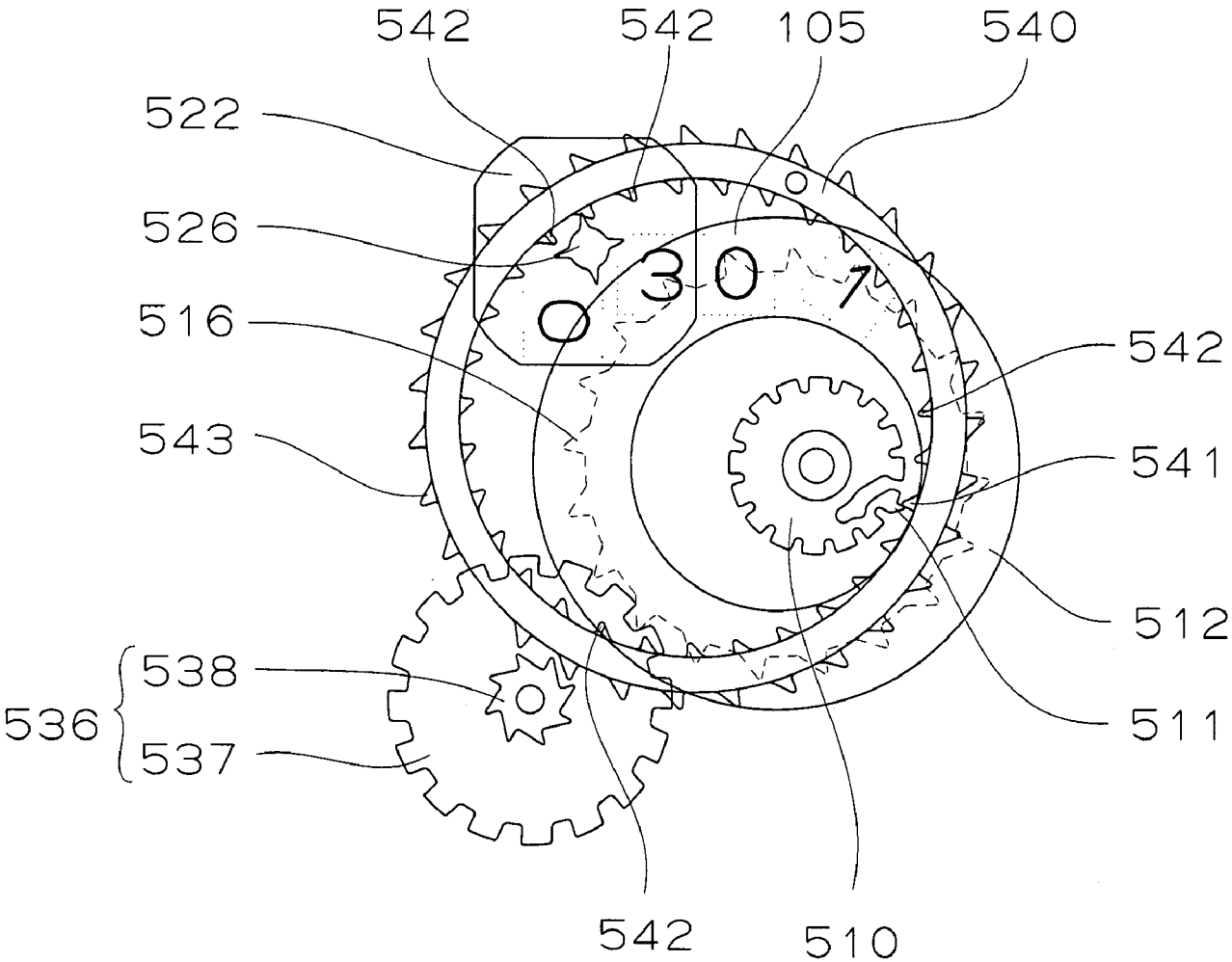
FIG. 8 is an enlarged partial plan view showing portions of the 1st date indicator, the 2nd date indicator and the program gear wheel under a state displaying "30th day" in the embodiment of the invention.

Referring to FIG. 1 to FIG. 8, by the fact that the hour wheel 354 rotates, the date indicator driving wheel 510 rotates, and the date finger 511 rotates the program gear wheel 540 by for one tooth in the counterclockwise direction only by one time in one day. By the fact that the program gear wheel 540 rotates, the 3rd program gear wheel 543 rotates the 1st date indicator 512 by for two teeth in the counterclockwise direction through the rotation of the calendar intermediate wheel 536, and thereby changes the day letter, which is displayed from the date window 105 by the 1st date indicator 512, to "0" from "9". At the same time as the 1st date indicator 512 is rotated by the 3rd program tooth 543, the 2nd program tooth 542 rotates the 2nd date indicator 522 by for one tooth in the counterclockwise direction, and thereby changes the day letter, which is displayed from the date window 105 by the 2nd date indicator 522, to "3" from "2". Accordingly, as shown in FIG. 8, by the date feed operation like the above, it is possible to display "30th day" from the date window 105 by the 2nd date indicator 522 and the 1st date indicator 512 by displaying "3" by the 2nd day letter 523 of the 2nd date indicator 522 and displaying "0" by the 1st day letter 513 of the 1st date indicator 512. The date feed operation like the above completes when the hour hand 356 and the minute hand 352 display 12 o'clock 0 minute.

Figure 9:
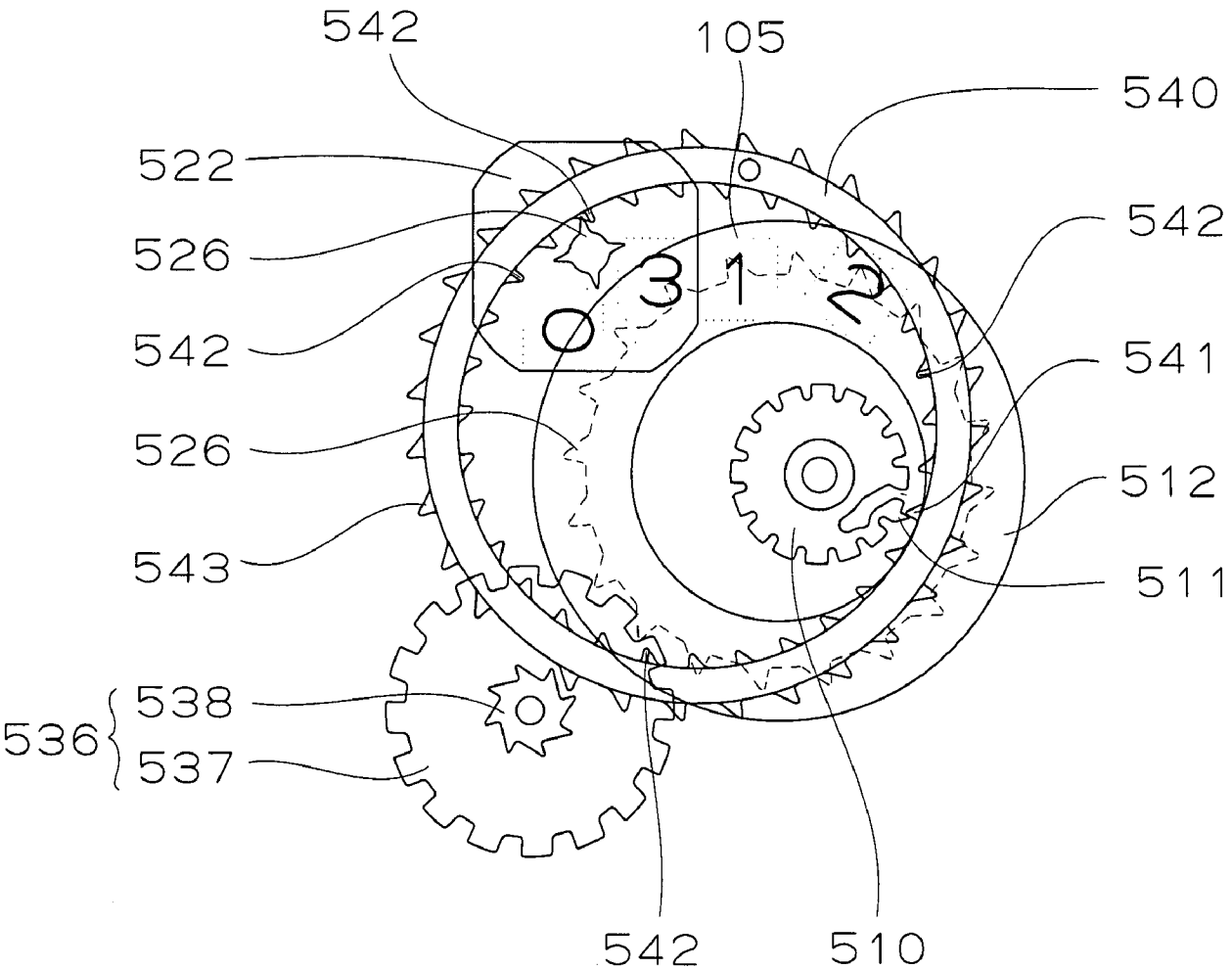
FIG. 9 is an enlarged partial plan view showing portions of the 1st date indicator, the 2nd date indicator and the program gear wheel under a state displaying "31st day" in the embodiment of the invention.

Referring to FIG. 8 and FIG. 9, additionally, by the fact that the hour wheel 354 rotates, the date indicator driving wheel 510 rotates, and the date finger 511 rotates the program gearwheel 540 by for one tooth in the counterclockwise direction only by one time in one day. By the fact that the program gear wheel 540 rotates, the 3rd program gear wheel 543 rotates the 1st date indicator 512 by for two teeth in the counterclockwise direction through the rotation of the calendar intermediate wheel 536, and thereby changes the day letter, which is displayed from the date window 105 by the 1st date indicator 512, to "1" from "0". At this time, the 2nd program tooth 542 does not rotate the 2nd date indicator 522.

Referring to FIG. 11, in the complete 500, by the date feed operation like the above, it is possible to display "31st day" from the date window 105 by the 2nd date indicator 522 and the 1st date indicator 512 by displaying "3" by the 2nd day letter 523 of the 2nd date indicator 522 and displaying "1" by the 1st day letter 513 of the 1st date indicator 512. A push/pull operation of the winding stem 310 and a rotation operation of the winding stem 310 can be performed by operating a "crown 504" rotating integrally with the winding stem 310.

Figure 10:
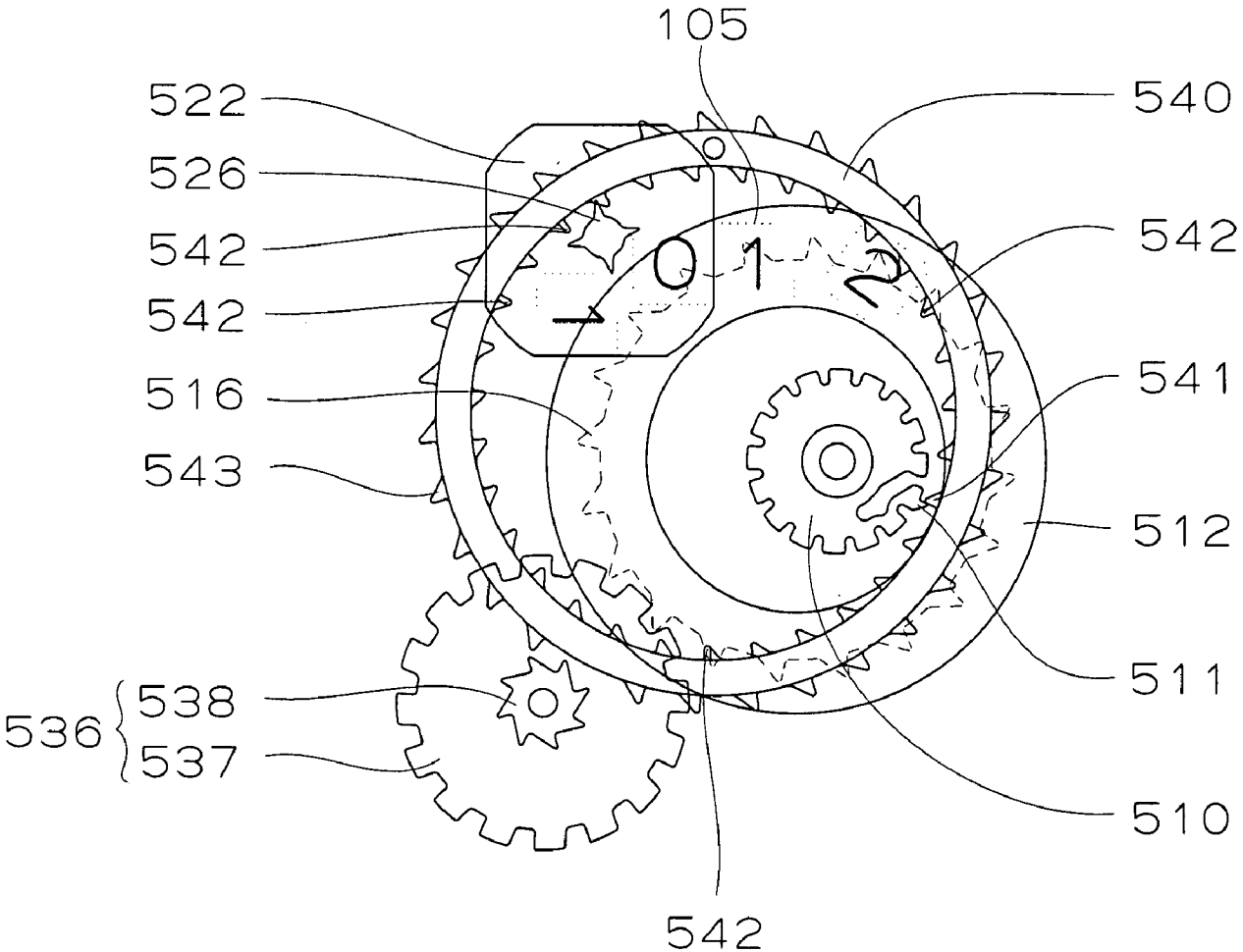
FIG. 10 is an enlarged partial plan view showing portions of the 1st date indicator, the 2nd date indicator and the program gear wheel under a state displaying "01 day" in the embodiment of the invention.

Referring to FIG. 9 and FIG. 10, additionally, by the fact that the hour wheel 354 rotates, the date indicator driving wheel 510 rotates, and the date, finger 511 rotates the program gearwheel 540 by for one tooth in the counterclockwise direction only by one time in one day. Even if the program gear wheel 540 rotates, there is no fact that the 3rd program tooth 543 rotates the 1st date indicator 512, and the day letter, which is displayed from the date window 105 by the 1st date indicator 512, is "1" intact. At this time, the 2nd program tooth 542 rotates the 2nd date indicator 522 only by for one tooth in the counterclockwise direction, and thereby changes the day letter, which is displayed from the date window 105 by the 2nd date indicator 522, to "0" from "3". Accordingly, as shown in FIG. 12, by the date feed operation like the above, it is possible to display "01 day" (i.e., "1st day") from the date window 105 by the 2nd date indicator 522 and the 1st date indicator 512 by displaying "0" by the 2nd day letter 523 of the 2nd date indicator 522 and displaying "1" by the 1st day letter 513 of the 1st date indicator 512.

Additionally, by the fact that the hour wheel 354 rotates, the program gear wheel 540 rotates, the day letter, which is displayed from the date window 105 by the 1st date indicator 512, is changed to "3" from "2", and thereby it is possible to display "03 day" (i.e., "2nd day") from the date window 105 by the 2nd date indicator 522 and the 1st date indicator 512. Additionally, by the fact that the hour wheel 354 rotates, the program gear wheel 540 rotates, the day letter, which is displayed from the date window 105 by the 1st date indicator 512, is changed to "3" from "2", and thereby it is possible to display "03 day") (i.e., "3rd day") from the date window 105 by the 2nd date indicator 522 and the 1st date indicator 512. Accordingly, by the date feed operation like the above, it is possible to display "01 day" to "31st day" from the date window 105 by the 2nd date indicator 522 and the 1st date indicator 512.

(2) Case where the Invention is Constituted by a Mechanical Timepiece

In a case where the invention is constituted by a mechanical timepiece, structures and actions of the switching mechanism, the calendar feed mechanism and the calendar correction mechanism are similar to the structures and the actions of the above-mentioned embodiment of the invention. Although details of the structure are not shown in the drawing, in the mechanical timepiece, by a rotation of a barrel gear wheel of a movement barrel complete, the second wheel &pinion performs one rotation in one minute through rotations of the center wheel & pinion and the third wheel-& pinion. A rotational speed of the second wheel & pinion is controlled by an escape wheel & pinion. A rotational speed of the escape wheel & pinion is controlled by a pallet fork. A fluctuation movement of the pallet fork is controlled by a balance with hairspring. By the rotation of the third wheel & pinion, the minute wheel performs one rotation in one hour. There is constituted such that, by the rotation of the minute wheel, the hour wheel performs one rotation in 12 hours through the rotation of the minute wheel. The date indicator driving wheel 510 rotates by the fact that the hour wheel rotates, and the date finger 511 rotates the program gear wheel 540 only by for one tooth in the counterclockwise direction only by one time in one day. By the date feed operation like this, it is possible to display the date from the date window of the dial by the 2nd day letter 523 of the 2nd date indicator 522 and the 1st day letter 513 of the 1st date indicator 512.

In a timepiece with a calendar mechanism of the invention, since a constitutional component of the drive mechanism is large, a working of the component is easy. Further, in a timepiece with a calendar mechanism of the invention, since the program gear wheel is thin, the whole of the movement of the timepiece is thinly constituted. Further, in a timepiece with a calendar mechanism of the invention, the calendar mechanism can be compactly formed.

If the invention is applied, it is possible to manufacture a timepiece with a calendar mechanism in which the component is easy to be worked. Further, if the invention is applied, it is possible to manufacture a timepiece with a calendar mechanism in which the whole movement has been thinly constituted. Additionally, if the invention is applied, it is possible to manufacture a timepiece with a calendar mechanism whose calendar display is large and easy to see.

What is claimed is:

1. A timepiece with a calendar mechanism comprising:

a drive mechanism for driving the timepiece with the calendar mechanism;

a time instant display wheel that undergoes rotation by an operation of the drive mechanism to display time instant information;

a first date indicator mounted to undergo intermittent rotation to display with a first date character the ones place of a date;

a second date indicator mounted to undergo intermittent rotation to display with a second date character the tens place of the date, the first and second date indicators being disposed in mutually adjoining positions so that the corresponding first and second date characters display the date; and a program gear wheel that intermittently rotates the first and second date indicators in accordance with an operation of the drive mechanism, the program gear wheel being ring-shaped with a central hole and having a program tooth disposed on an outer periphery part of the program gear wheel for intermittently rotating the first date indicator and another program tooth disposed in an inner periphery part of the program gear wheel for intermittently rotating the second date indicator, a rotation center axis of the second date indicator being disposed outside of the first date indicator and inside of the program gear wheel.

2. A timepiece with a calendar mechanism according to claim 1; wherein the program gear wheel has 31 driving program teeth for engagement with the drive mechanism, 30 tooth parts for rotating the first date indicator, and four tooth parts for rotating the second date indicator, the first date indicator having a display face for displaying date characters including ten numerals arranged in a circumferential direction in the order of "1", "2", "3","4", "5", "6", "7", "8", "9", and "0", and the second date indicator having a display face for displaying date characters including four numerals arranged in a circumferential direction in the order of "0", "1", "2", "3".

3. A timepiece with a calendar mechanism according to claim 1; further comprising:

a date indicator driving wheel mounted to undergo rotation in accordance with operation of the drive mechanism, the date indicator driving wheel being disposed in an inner part of the center hole of the program gear wheel;

a date finger mounted to undergo rotation in accordance with rotation of the date indicator driving wheel; and a program date indicator mounted to undergo rotation in accordance with rotation of the date finger.

4. A timepiece with a calendar mechanism according to claim 1; further comprising:

a program date indicator mounted to undergo rotation; and a calendar intermediate wheel mounted to undergo rotation in accordance with rotation of the program date indicator;

wherein a rotation center axis of the calendar intermediate wheel is disposed outside of the first date indicator and outside of the program gear wheel, and the first date indicator undergoes rotation in accordance with rotation of the calendar intermediate wheel.

5. A timepiece with a calendar mechanism according to claim 1; further comprising:

a winding stem mounted to undergo movement between a pulled out state and pushed in state and to undergo rotation at least in the pulled out position; and a calendar correction mechanism that performs calendar date correction by correcting at least one of a display content of the first date indicator and a display content of the second date indicator by rotation of the winding stem in the pulled out state of the winding stem, the calendar correction mechanism having a day correction wheel that undergoes rotation in accordance with rotation of the winding stem and that rotates the program gear wheel in the pulled out state of the winding stem.

6. A timepiece with a calendar mechanism according to claim 1; wherein a rotation center axis of the time instant display wheel is disposed in an inner part of the center hole of the program gear wheel.

7. A timepiece with a calendar mechanism according to claim 1; wherein the first and second date indicators are disposed in overlapping relation to one another.

8. A timepiece with a calendar mechanism comprising:

a drive mechanism;

a time display wheel that undergoes rotation by an operation of the drive mechanism to display time information;

a first date indicator mounted to undergo intermittent rotation to display a ones place of a date;

a second date indicator mounted to undergo intermittent rotation to display a tens place of the date; and a program gear wheel that intermittently rotates the first and second date indicators in accordance with operation of the drive mechanism, the program gear wheel having a first program tooth disposed on an outer peripheral part of the program gear wheel for intermittently rotating the first date indicator and a second program tooth disposed in an inner peripheral part of the program gear wheel for intermittently rotating the second date indicator.

9. A timepiece with a calendar mechanism according to claim 8; wherein the program gear wheel is ring-shaped with a central hole.

10. A timepiece with a calendar mechanism according to claim 8; wherein the first and second date indicators are disposed in mutually adjoining positions so that date characters in the corresponding ones place and tens place display the date.

11. A timepiece with a calendar mechanism according to claim 8; wherein a rotation center axis of the second date indicator is disposed outside of the first date indicator and inside of the program gear wheel.

12. A timepiece with a calendar mechanism according to claim 8; wherein the program gear wheel has 31 driving program teeth for engagement with the drive mechanism, 30 tooth parts for rotating the first date indicator,and four tooth parts for rotating the second date indicator, the first date indicator having a display face for displaying date characters including ten numerals arranged in a circumferential direction in the order of "1", "2", "3", "4", "5", "6", "7", "8", "9", and "0", and the second date indicator having a display face for displaying date characters including four numerals arranged in a circumferential direction in the order of "0", "1", "2", "3".

13. A timepiece with a calendar mechanism according to claim 8; further comprising:

a date indicator driving wheel mounted to undergo rotation in accordance with operation of the drive mechanism, the date indicator driving wheel being disposed in an inner part of the center hole of the program gear wheel;

a date finger mounted to undergo rotation in accordance with rotation of the date indicator driving wheel; and a program date indicator mounted to undergo rotation in accordance with rotation of the date finger.

14. A timepiece with a calendar mechanism according to claim 8; further comprising:

a program date indicator mounted to undergo rotation; and a calendar intermediate wheel mounted to undergo rotation in accordance with rotation of the program date indicator;

wherein a rotation center axis of the calendar intermediate wheel is disposed outside of the first date indicator and outside of the program gear wheel, and the first date indicator undergoes rotation in accordance with rotation of the calendar intermediate wheel.

15. A timepiece with a calendar mechanism according to claim 8; further comprising:

a winding stem mounted to undergo movement between a pulled out state and pushed in state and to undergo rotation at least in the pulled out position; and a calendar correction mechanism that performs calendar date correction by correcting at least one of a display content of the first date indicator and a display content of the second date indicator by rotation of the winding stem in the pulled out state of the winding stem, the calendar correction mechanism having a day correction wheel that undergoes rotation in accordance with rotation of the winding stem and that rotates the program gear wheel in the pulled out state of the winding stem.

16. A timepiece with a calendar mechanism according to claim 8; wherein a rotation center axis of the time display wheel is disposed in an inner part of the center hole of the program gear wheel.

17. A timepiece with a calendar mechanism according to claim 8; wherein the first and second date indicators are disposed in overlapping relation to one another.

* * * * *